US006944915B2

(12) United States Patent
Atkinson

(10) Patent No.: US 6,944,915 B2
(45) Date of Patent: Sep. 20, 2005

(54) MODIFIED WORKER OPERATION IN TEXTILE CARDING

(75) Inventor: Kenneth Ross Atkinson, Highton (AU)

(73) Assignee: Commonwealth Scientific and Industrial Research Organisation, Australian Capital Territory (AU)

( * ) Notice: Subject to any disclaimer, the term of this patent is extended or adjusted under 35 U.S.C. 154(b) by 0 days.

(21) Appl. No.: 10/925,184

(22) Filed: Aug. 23, 2004

(65) Prior Publication Data

US 2005/0071955 A1 Apr. 7, 2005

Related U.S. Application Data

(63) Continuation of application No. 10/296,420, filed as application No. PCT/AU01/00653 on Jun. 1, 2001, now abandoned.

(30) Foreign Application Priority Data

Jun. 1, 2000 (AU) ..... PQ7896
Nov. 8, 2000 (AU) ..... PR1315

(51) Int. Cl.[7] ..... D01G 15/00
(52) U.S. Cl. ..... 19/98; 19/105
(58) Field of Search ..... 19/98, 99, 100, 19/101, 105, 108, 112, 114, 102, 104, 110, 111, 113, 200, 204, 107

(56) References Cited

U.S. PATENT DOCUMENTS

| | | | |
|---|---|---|---|
| 493,752 | A | 3/1893 | Clarenbach et al. |
| 709,980 | A | 9/1902 | Gilljam |
| 1,433,927 | A | 10/1922 | Bates |
| 1,564,600 | A | 12/1925 | Maly |
| 1,567,841 | A | 12/1925 | Curtin |
| 1,598,800 | A | 9/1926 | Bredbury |
| 1,833,811 | A | 11/1931 | Allen et al. |
| 1,913,016 | A | 6/1933 | Walsh |
| 2,086,308 | A | 7/1937 | Van Hille et al. |
| 2,964,801 | A | 12/1960 | Riehl et al. |
| 3,032,831 | A | 5/1962 | Carminati |
| 3,290,729 | A | 12/1966 | Maynard |
| 4,067,086 | A | 1/1978 | Bernhardt et al. |
| 4,129,924 | A | 12/1978 | Wirth |
| 4,274,177 | A | 6/1981 | Grimshaw et al. |
| 4,364,153 | A | 12/1982 | Beneke et al. |

FOREIGN PATENT DOCUMENTS

| | | |
|---|---|---|
| DE | 33 15 839 | 11/1984 |
| GB | 2 247 253 | 2/1992 |

*Primary Examiner*—Gary L. Welch
(74) *Attorney, Agent, or Firm*—Merchant & Gould P.C.

(57) ABSTRACT

A textile machine segment including a first or main roller (12) adapted to support and convey a travelling fibre web, associated second (16) and third (14) rollers cooperable with each other and at respective nips (24, 25) with the first roller as the three rollers rotate, to open the web and detach a mat of fibre tufts at the nip (25) between the first and second rollers and to return the tufts to the first roller at the nip (24) between the first and third rollers, and drive means (100) for rotating the rollers, wherein the drive means is arranged to rotate the second roller in a rotational direction that is the same as that of the first roller and opposite that of the third roller.

17 Claims, 8 Drawing Sheets

MODIFIED WORKER OPERATION IN TEXTILE CARDING

FIELD OF THE INVENTION

This invention is concerned generally with the working interaction between roller elements and cylinders of textile-carding machines. The invention is applicable to working points throughout a textile card, including but not limited to the licker, breast, or swift.

BACKGROUND ART

Roller carding is one of the principal means of carding textile fibres. The rollers are usually wound with card wire to provide a finely pinned surface that is used to reduce the clumps of fibre to individual fibres and eventually assemble them into either a web or a sliver. In the conventional design, the rollers have a specific relationship to each other in terms of diameter and direction of rotation. The roller that individualises the fibres is called a worker and rotates in the opposite direction as the larger cylinder that carries the fibre forward through the machine. The diameter of the worker roller is usually about 250 mm, including wire, and that of the cylinder on which it is located depends on the part of the card being considered, e.g., the breast may be about 1000 mm in diameter and the main cylinder up to 1500 mm diameter.

Operating in co-operation with the worker is a stripper roller. Strippers are usually about 150 mm in diameter and rotate in the same direction as the worker and in the opposite direction to the cylinder, usually with much higher surface speeds than the worker, but slower than that of the cylinder. The purpose of a stripper is to remove fibre from the worker and return it to the cylinder for further processing by workers. The important role of the stripper is to keep the pins of the worker free of fibre so that it can continue to tease open the clumps of fibre being presented by the cylinder. Stripping of the stripper by the cylinder is facilitated by the higher surface speed of the cylinder and the forward orientation of both sets of pins.

This method of opening fibre clumps needs to be contrasted with that of flats, which is the traditional technology of the short-staple industry. A major physical requirement for effective opening of short-staple fibres is for large numbers of pins on the working surface because of the fineness of the fibres. In practice, this has meant that bars, rather than rollers, have been used to support the pins because of the larger numbers that can be provided for. Flats can be either stationary or moving, but if stationary, fibre build-up in the pins is a major problem leading to a reduction in effectiveness. The advantage of moving flats is that fibre caught in the pins can eventually be removed thereby improving the opening efficiency while providing a capacity for the removal of trash. The disadvantage of removing fibre from the pins and not returning it to the system is the increased fibre loss.

Workers provide a number of benefits for carding compared with flats. Firstly, workers always operate at maximum opening efficiency because the pins are never loaded with fibre. Secondly, there is no loss of fibre from the system because all of the fibre that is 'worked' is returned to the cylinder. Thirdly, worker-strippers provide good blending and evenning because of feedback of opened fibre onto the feed. Fourthly, because each worker-stripper unit is independent, it is possible to use individual settings, speeds, and pinnings to optimise performance.

Nevertheless, there are well-recognised shortcomings of the traditional worker-stripper arrangement, viz., the low packing density of units because of the large diameters and the need to provide a wide clearance between a worker and the subsequent stripper to eliminate interference, i.e., robbing of fibre. More exactly, in worsted carding, worker diameters are typically about 250 mm and the clearance to the subsequent stripper is usually set at about 180 mm. When combined with a stripper diameter of 150 mm, the total arc of the cylinder required for proper operation is about 580 mm, which is a large proportion of the total arc. Another disadvantage is that there is no opportunity for removal of contaminants such as vegetable matter in wool, or trash in cotton, which is one disadvantage restricting the application of rollers to short-staple carding. Finally, it is difficult to fully enclose the workers because the backward facing pins cannot prevent fibre slipping off in the event of contact with the enclosure or any other surface.

The deficiencies of the traditional worker-stripper system are significant for textile carding whenever the quality of the web is directly important for the quality of the final product, such as in non-woven and woollen carding. These end-uses would benefit from the greater opening provided by more units. For worsted carding, where the product is a sliver that is subject to further processing, the disadvantage is that current machines are very large, the cost of which would be significantly lower if the size was reduced. In the case of short-staple carding, the impediments to using worker-strippers are the lack of trash removal facilities, the low density of units, and the difficulty of fully enclosing the rollers. Full enclosure of cotton cards is an essential requirement because of health and safety concerns.

It was therefore an object of the invention to at least in part address one or more of the above problems arising from the application of rollers to textile carding while preferably retaining benefits of the existing systems.

SUMMARY OF THE INVENTION

In essence, the invention involves a reversal of the long-standing direction of rotation of the roller that conventionally is termed a worker. With this modification, which affords a number of advantages, it is beneficial to also alter the conventional size relationships between the cylinders or rollers of the textile machine. By reversing the direction of worker rotation it is possible to substantially reduce the separation of a worker from the subsequent stripper on the cylinder, and this separation can be made still smaller by also reducing the relative size of the worker.

In conventional roller carding, as already discussed, the first or primary roller is a cylinder or swift, the second roller is usually referred to as a worker, and the third roller is called a stripper. Conventionally, workers pick up fibre from the cylinder and deposit it with the same orientation, i.e., the upper surface of a fibre tuft remains on top after re-deposition on the cylinder. In the application here, because of the relative directions of rotation, the arrangement is such that fibre clumps are inverted during re-deposition, i.e., the top surface of a tuft is on the bottom after re-deposition. For this reason related to the preferred practice of the invention, the second roller may conveniently be referred to as an inverter to distinguish its operation from that of a worker. Inverters, therefore, provide an additional degree of fibre mixing compared with conventional workers.

In a first aspect, the invention provides a textile machine segment including a first or main roller adapted to support and convey a travelling fibre web, associated second and third rollers cooperable with each other and at respective nips with the first roller as the three rollers rotate, to open the web and detach a mat of fibre tufts at the nip between the first and second rollers and to return the tufts to the first roller at the nip between the first and third rollers, and drive means for rotating the rollers, wherein the drive means is arranged to rotate the second roller in a rotational direction that is the same as that of the first roller and opposite that of the third roller.

The invention also provides, in a second aspect, a method of treating a travelling fibre web, including supporting and conveying the web on a rotating first roller, and operating respective pairs of second and third rollers cooperable with each other and at respective nips with the first roller whereby to open the web and detach a mat of fibre tufts at the nip between the first and second rollers and to return the tufts to the first roller at the nip between the first and third rollers, wherein said operation of the respective pairs of second and third rollers is effected by rotating the second roller in a rotational direction which is the same as that of the first roller and opposite that of the third roller.

The second and third rollers may hereinafter be referred to as the inverter and stripper respectively.

The rollers preferably have wire clothing about their cylindrical surfaces, which clothing includes a multiplicity of projecting pins or teeth inclined at less than 90° to the respective surface. Preferably, the respective rollers each have a substantially uniform direction of this inclination. Advantageously, in the region of transfer of fibres from the second or inverter roller to the third or stripper roller, the pins of the respective rollers are inclined in the same direction. Preferably, the direction of inclination is in the direction of rotation of the respective rollers.

Preferably, the ratio of the diameters of the inverter and stripper rollers is less than 1.5, and preferably 1.0 or less. In a range of embodiments, the ratio may vary between 0.3 and 0.8, eg. 0.5 to 0.6.

In terms of actual diameter values, the inverter roller is preferably of a diameter in the range 50 to 150 mm, more preferably in the range 75 to 100 mm, eg. about 80 to 90 mm. The stripper roller is preferably of a diameter in the range 100 to 200 mm, more preferably in the range 110 to 150 mm, eg. about 110 to 130 mm.

In one embodiment the textile machine segment is adapted for treating a wool fibre web and the arc separation about the first roller between the nip of the inverter roller of a pair and the stripper of the next pair is no greater than 150 mm, more preferably less than 130 mm, eg. about 90 to 120 mm. The arc is preferably greater than the mean fibre length of the wool fibres of the web.

Reversal of the rotational direction of the second roller and reduction in the size of this second or inverter roller relative to the stripper roller permits a reduction in the separation of working points where multiple inverter/stripper pairs are disposed on a single main cylinder. In the case of the swift in a high-speed card with double-doffing, the need with conventional worker/stripper pairs to increase the diameter of the swift may thereby be in part or wholly overcome. Alternatively, for a given diameter of main cylinder, the number of working points may be increased and this advantage may be achieved at any of the carding cylinders of a worsted card.

The textile machine segment may be one of a number of similar card segments in a textile carding machine, eg, a worsted carding machine or card. The invention may be applied to each working point on each of the carding cylinders, including for example, the licker, the breast, and the swift or main cylinder.

Other changes follow from the altered direction of rotation of the inverter (the second roller) compared to a conventional worker. Firstly, the fibre being held by the pins of the inverter is now withdrawn through the nip with the first or primary roller, leading to more intense combing of the tails of the tufts. For conventional workers by comparison, the fibre is lifted off the cylinder or primary roller as soon as it is gripped, limiting its interaction with the pins of the cylinder. Secondly, for inverters, the pins preferably face in the direction of rotation, which improves fibre control because fibre can only be removed by forward facing pins of a higher speed surface, viz., a stripper. A further benefit of this mode of operation is that fibre, once hooked, cannot slip off, which is a problem for the operation of workers. Thirdly, the transfer of fibre from the inverter to the stripper is smoother in the preferred case where the pins of both rollers face in the same (forward) direction, which also helps to retain fibre alignment. Another consequence of smoother fibre transfer is the improvement of stripper function because the pins of the stripper are no longer loaded, i.e., the fibre is not pulled down to the bottom of the pins where it is difficult to remove. High drafts conventionally used in worker-stripper operation, by comparison, lead to loading of the pins of the stripper and loss of alignment of the fibre because of the opposed pins. Fourthly, in marked contrast to workers, the outer (returning) surface of an inverter is free of fibre, which reduces fibre loss as fly and enables other processing elements to be located relatively close without fear of interference. Finally, the spatial independence of inverter-stripper pairs provides the opportunity to set the absolute or relative diameters of the rollers according to other more general machine-design criteria.

The aforedescribed textile machine segment may be one of a number of similar segments in a carding machine, e.g., a worsted carding machine or card. The invention may be applied to each working point on any carding cylinder or roller as the primary roller, including for example, the licker, the breast, and the swift or main cylinder.

BRIEF DESCRIPTION OF THE DRAWINGS

The invention will now be further described by way of example only, with reference to the accompanying drawings, in which:

FIG. 2 shows the situation when the diameters of the rollers are the same as for conventional worker-stripper pairs, FIG. 3 shows the additional saving in space made possible by reducing the diameters of the rollers, and FIG. 4 shows that inverter-stripper pairs can be arranged to be almost touching if the fibre length is sufficiently short;

FIG. 7 showing an overall view whereas FIG. 8 is a local enlargement;

OPERATION OF INVERTERS IN TEXTILE CARDING

Figure 1:
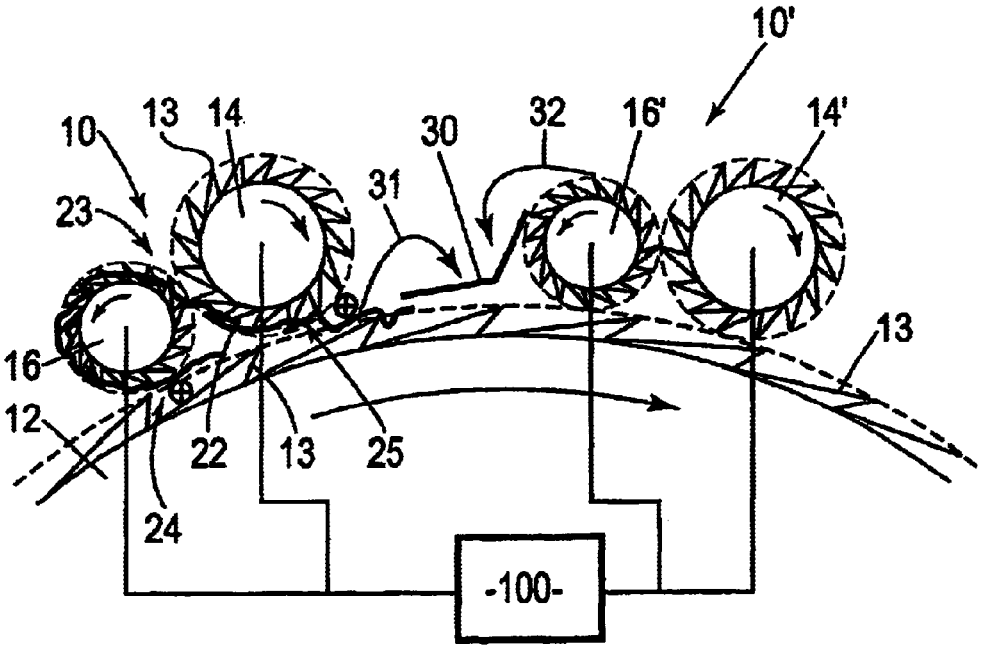
FIG. 1 is a schematic illustration of an inverter-stripper segment of a textile carding machine, showing the principle of operation, including the inversion of tufts.

FIG. 1 shows a pair of inverter-stripper segments 10, 10' of a textile carding machine. Each segment 10, 10' comprises a second or inverter roller 14, 14' and a third or stripper roller 16, 16', each being a cylinder of a standard roller diameter for long-staple carding, operating on a larger diameter primary roller or cylinder 12. Use on smaller diameter primary rollers is possible within the broad concept of the invention. The respective arrows in the diagram indicate the directions of rotation of the cylinders or rollers 12, 14, 16. Each of the rollers is clothed in an appropriate fine-toothed wire mesh according to conventional practice comprising pins or teeth 13 inclined to the respective cylindrical surface, at an acute angle to the direction of rotation, as illustrated.

The rollers 12, 14, 16 are driven by a conventional mechanism indicated diagrammatically at 100 and including the usual motors and transmission systems (not detailed). A travelling fibre web is held and conveyed by cylinder 12 through the successive nips 24, 25 with rollers 16, 14 respectively. The surface speed of the cylinder 12 is faster than that of the stripper 16, which in turn is faster than the relatively slow-moving inverter 14. At inverter/cylinder nip 25, the slow-moving inverter opens up the fibre web and detaches a proportion of the fibres as a mat 22 of tufts on the surface of the Inverter 14. This mat is carried up between the inverter and stripper, and in the region 23 of their closest approach, the mat is then transferred onto the stripper 16, which returns the tufts into the main web at stripper/cylinder nip 24.

The reversed direction of rotation of the inverter 14, compared with a conventional worker, fundamentally alters the carding operation and particularly how the rollers can be integrated around the cylinder. In the case of the conventional rotating worker, the pins at the nip move in the same direction as the cylinder or swift, which means that once the fibre is caught it is lifted immediately off the surface of the cylinder thereby stopping any further working of the fibre. For the inverter 14, however, because it rotates in the opposite direction, the tails of fibre caught in the pins of the inverter, may, depending on conditions in the nip such as pinning, setting, and fibre density, continue to be combed by the pins of cylinder 12 for a longer period until the inverter has rotated sufficiently to withdraw them. This considerably improves the effectiveness of the working action. The extent to which the additional combing occurs may be controlled by selecting the appropriate operating conditions and pinning for the card.

Inversion of tufts is shown schematically in FIG. 1 by noting that the top of a tuft immediately after capture, denoted by a '+' sign, is on the bottom after re-deposition on the cylinder, i.e., the tuft is inverted.

Another important difference between inverters and workers is that the tendency for fibre to slip off the pins of a worker during the initial stages of its movement out of the nip is eliminated. In contrast, as an inverter rotates, the grip on the fibre increases because the tendency is now for the fibres to slip towards the base of the pins, which increases the hold of the inverter pins, with the effect of providing greater control over the opening function of the roller.

At the region 23 of transfer of the fibre from inverter to stripper, the pins of the rollers 14, 16 point in the same direction instead of in opposite directions as with conventional workers and strippers. Provided the draft between the rollers is appropriate, this provides for a smoother transfer of fibre from the inverter to the stripper, eliminating, or at least reducing, the possibility of fibre breakage or nep formation. A further option is to reduce the stripper-inverter draft, allowing some fibre to recirculate around the inverter. The benefit of this mode of operation is to increase the blending capacity of the system, which may be beneficial for particular fibres or machine configurations, such as short-fibres and very small inverter diameters.

A parameter of practical interest in carding is the draft between the cylinder and the inverter, i.e., the ratio of surface speeds, and it is a potential concern that reversing the direction of rotation might upset common practice. It can easily be demonstrated, however, that, in respect to drafting effect, inverter operation is substantially identical to conventional worker operation except at very low drafts, which are uncommon. In most carding operations, the speed of the cylinder is usually 40 or more times faster than that of a worker. If the speed of the inverter is the same as that of a worker, calculations show that, contrary to expectation, the difference in draft is only 2 units, say 39 for a worker and 41 for the inverter. Given the large drafts commonly in use, differences of this magnitude are of no concern. This surprising and useful outcome means that the surface speed of the inverter can be set simply by the need to ensure that the pins are free of fibre and therefore able to work efficiently.

Experience with the operation of inverters shows that the action of the pins of the cylinder on the tails of fibres held by the pins of the inverter releases contaminants mixed with the fibre into the space above the cylinder. Such released contaminant material is shown schematically at 31 in FIG. 1. Placing a tray 30 adjacent to the inverter 14 to catch this material 31 provides a means for removal of the contaminants. The stripper 16 also has been observed to throw out particulate matter 32, a process that becomes more effective the smaller the diameter. The tray 30 can be adapted to collect both streams of material as shown in FIG. 1.

Figure 2:
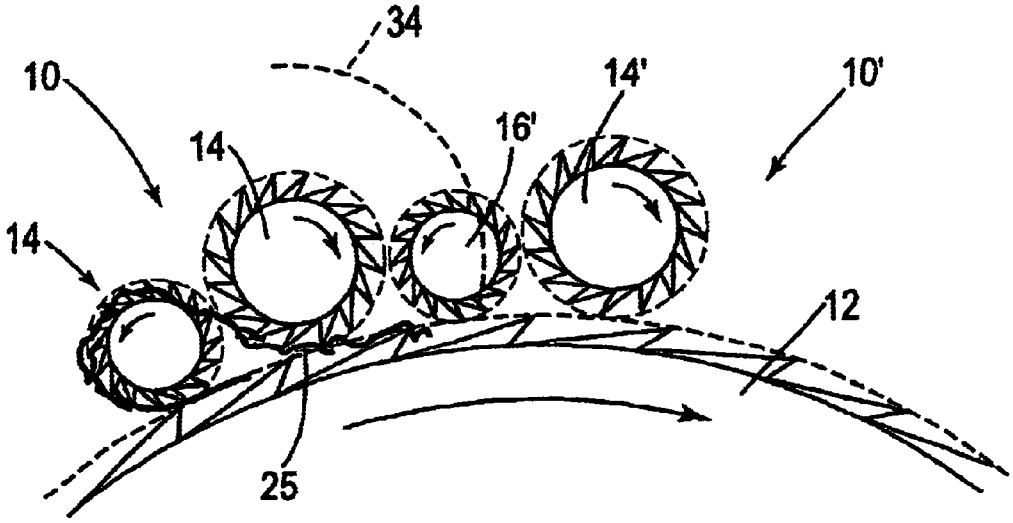
FIGS. 2 to 4 illustrate schematically how the use of inverters saves space around carding cylinders.
Figure 3:
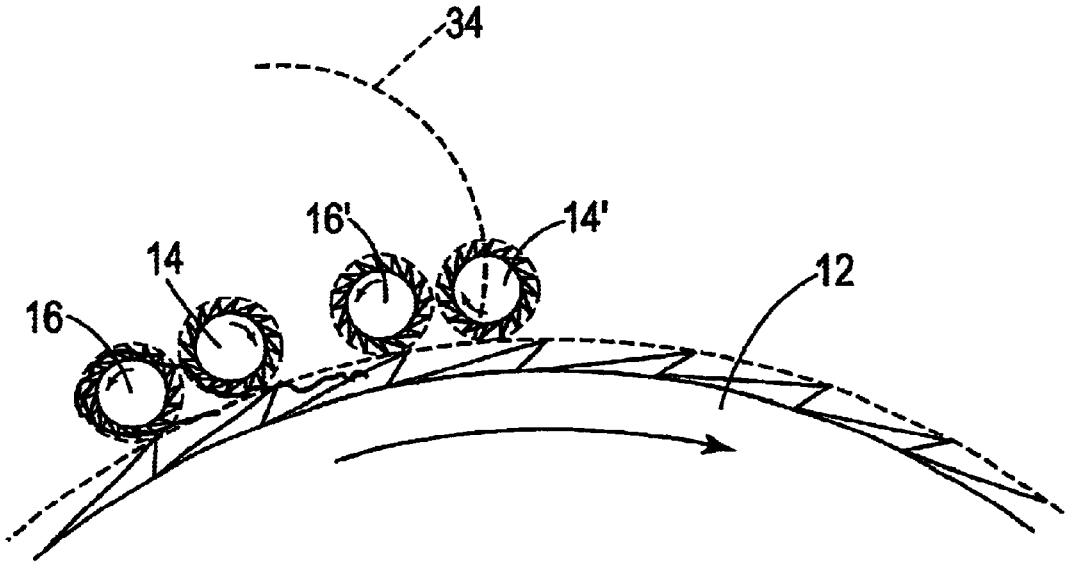
Figure 4:
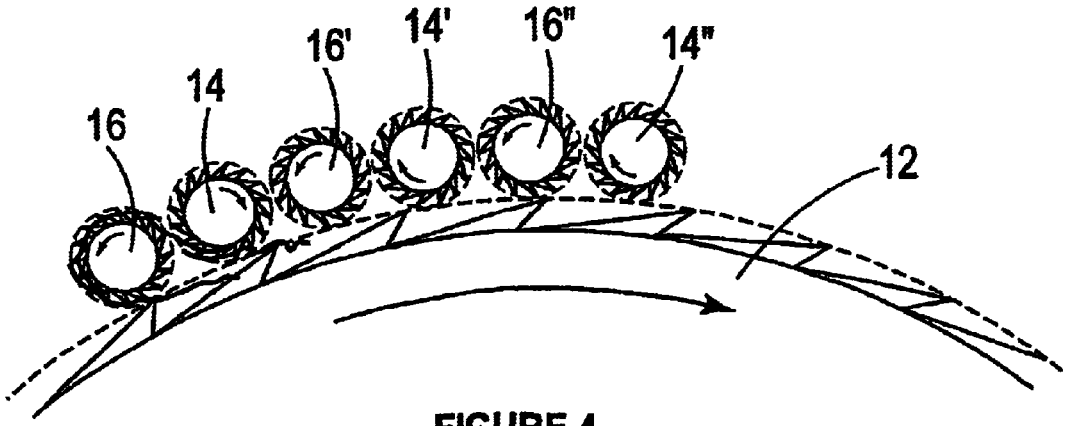

The three diagrams of FIGS. 2 to 4 show the extent to which inverter-stripper pairs can be placed much closer to each other than the equivalent worker-stripper pairs. Arc 34 (FIGS. 2 and 3) indicates the envelope of the tips of the fibres that would project from the inverter 14 if it was operating as a worker. The following stripper 16' must be located further away than this envelope otherwise it will strip fibre prematurely from the preceding worker. As shown in FIG. 2, the situation for inverter operation is quite different. The closest position of the following stripper 16' is set by either the surface of inverter 14 or the extent of the tips of the longest fibres from the nip 25 of inverter 14 and the cylinder 12.

The significant advantage of the inverter format is that when multiple units are employed on a cylinder, the clearance between an inverter 14 and the subsequent stripper 16' can be substantially decreased below the 180 mm normally provided between workers and the subsequent stripper for long-staple carding. Experimentation suggests that the clearance may be reduced to as little as 5 mm provided the distance between the nip of the inverter 14 and that of the subsequent stripper 16' is longer that about half the longest fibre, which is about 100 mm for wool, but only about 20 mm for short-staple fibre such as cotton. This close packing of rollers about the cylinder is possible only because of the reverse direction of rotation of the inverter.

Further compacting of the system can be achieved by reducing the diameters of the rollers. One possible configuration is shown in FIG. 3, in which the diameters of inverters 14, 14' and strippers 16, 16' are shown smaller, but equal. In practice the diameter of inverter 14 can be made reasonably small provided there is sufficient strength in the section to withstand the loads generated by the fibre. It is the diameter of stripper 16, however, that must be kept large enough to allow efficient stripping by the cylinder 12. In practice, a reasonable rule of thumb is for the minimum circumference of the stripper to be set at about the same length as that of the longest fibre, e.g., about 200 mm for wool, which means that the diameter of the stripper can be as small as about 70 mm. This is not an absolute requirement and smaller values are consistent with the scope of the invention.

For carding of short-staple synthetic fibres where contamination from trash is not a concern, there is no need for the presence of trays, which means that the inverter can be located closer together. In this application, the limit to how close the units can be placed together is set either by the necessity to avoid contact between an inverter and the subsequent stripper, or for the respective nips between the main cylinder and the inverter and the subsequent stripper to be further apart than about half the length of the longest fibre, whichever one is satisfied. An example of this geometry is shown in FIG. 4 in which the minimum separation is set by the clearance between an inverter 14, 14' and a subsequent stripper 16, 16'.

Although reducing the diameter of the inverter reduces the pinning available to catch and open fibre clumps, experiments show that, contrary to expectation, there is no effect on the properties of the final product. For example, for worsted carding, inverters of about 80 mm diameter gave the same hauteur and noil as workers of 240 mm diameter. The reason for this result is that only a small number of pins of the working roller are needed for effective operation, provided they are not loaded with fibre and operate at maximum efficiency. For inverter operation, reducing the diameter provides a benefit because it means that fibre caught by the pins of the inverter is quickly passed onto the stripper ensuring that the pins are free and are able to collect fibre efficiently from the cylinder.

The savings in cylinder arc possible from using inverters, therefore, can be used in two ways, either:

- to significantly reduce the size of the card without any loss of quality (i.e. without reduction of the number of opening rollers); or
- to leave the cylinder sizes the same but employ more inverter-stripper pairs.

The invention will now be further described in terms of its application to carding processes widely used in the textile industry, viz., short-staple carding, non-woven carding, and worsted carding.

Embodiment for Short-staple Carding

Figure 15:
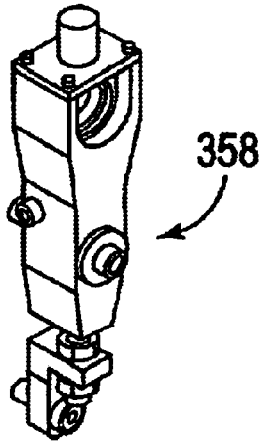

For short-staple cards, the maximum fibre length is typically less than 40 mm, which enables the diameter of the rollers to be decreased, thereby significantly increasing the number of pairs that can be installed. Consequently, the previous disadvantage of the roller system is overcome. One possible application of inverters to cotton carding is shown in FIG. 15.

Figure 5:
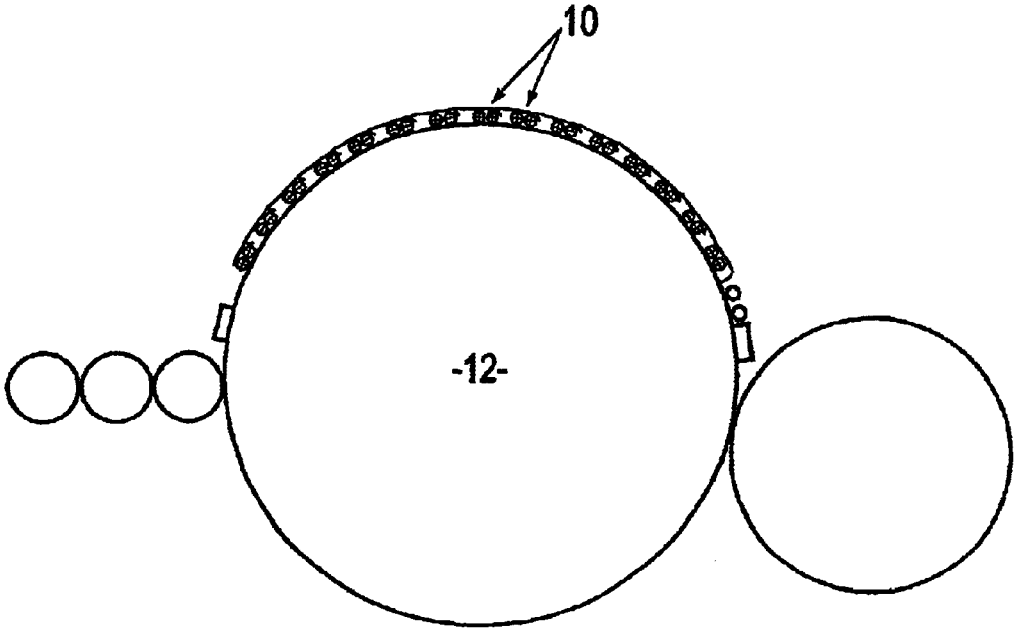
FIG. 5 is a diagrammatic representation of an embodiment applicable to short-staple carding.
Figure 6:
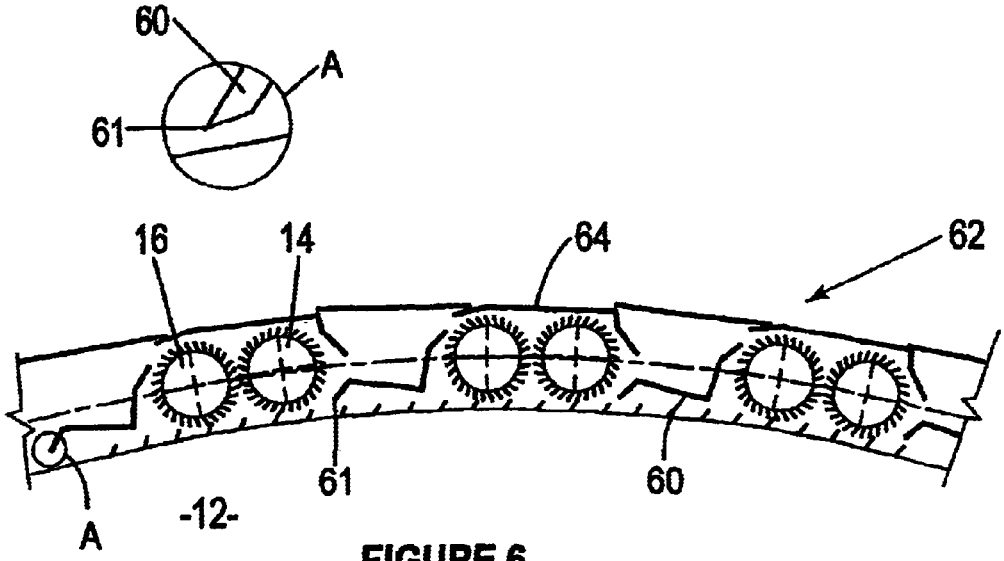
FIG. 6 depicts the detail of the waste collection system of the embodiment of FIG. 5.

In this case, inverter and stripper diameters are both set at about 31 mm and the cylinder at 1200 mm approximately. FIG. 5 shows fifteen—invertor-stripper (worker-stripper) pairs 10 fitted around the same arc as commonly used by moving flats. FIG. 6 shows the detail of trash collection trays 60 and enclosure 62 of the inverter-stripper pairs 10. Enclosing the inverters and strippers with closely fitting covers 64 is now possible because of the mode of operation. Previously, fibre was only loosely held by the worker because of the backward facing pins. In practice, this meant there was a significant risk that a closely fitting tray would strip fibre off the pins, impeding fibre transfer. Inverters therefore offer a three-fold benefit for short-staple carding: firstly, a significant increase in the number of rollers that can be used; secondly, each roller operates at maximum efficiencies offering superior opening perfomance; and thirdly, reduced fibre loss for short-staple carding where contamination is not an issue.

The ducts to which trash is delivered from the trays 60 are designed to prevent return of trash to the cylinder and can be fitted with removable top covers to provide easy access for cleaning. The leading edge 61 of the tray 60 adjacent to the cylinder is the normal mote knife arrangement for cotton cards and is indicated in the detail of Circle A, FIG. 6.

Figure 7:
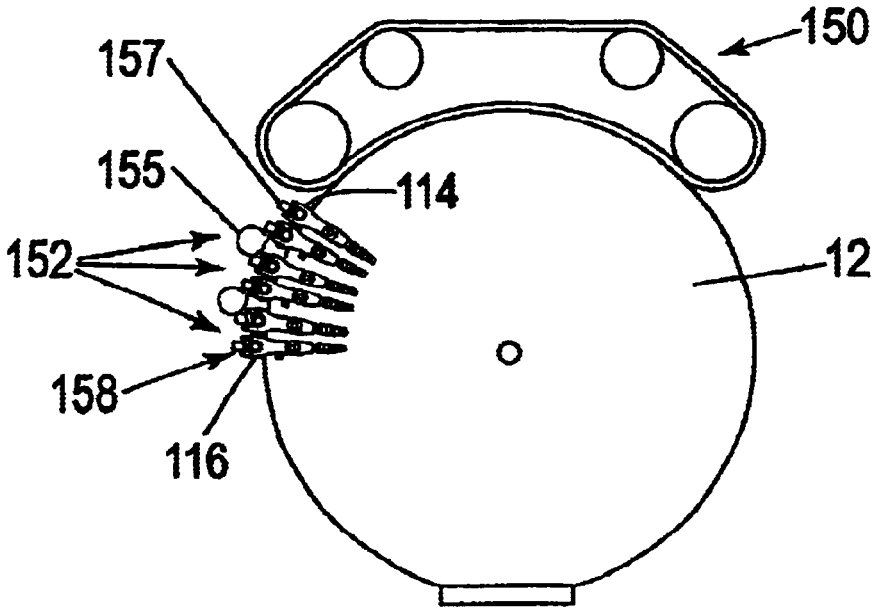
FIGS. 7 and 8 depict the use of inverters in combination with moving flats for short-staple carding.
Figure 8:
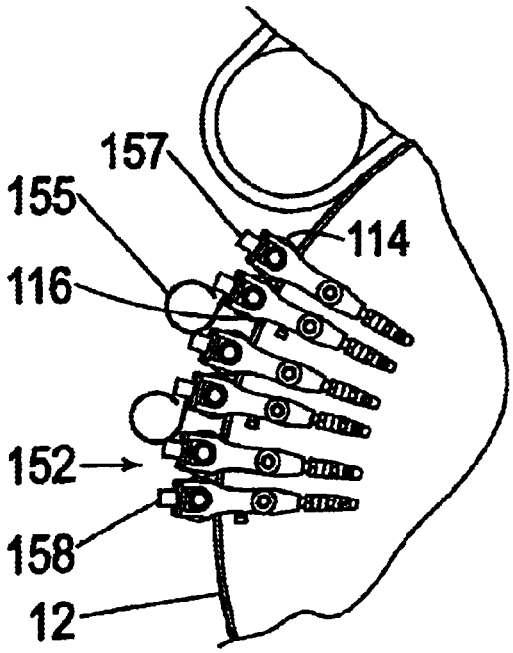

It is consistent with the invention to use inverter-stripper pairs in combination with existing flats systems, either moving or fixed. FIGS. 7 and 8 show inverters being used in combination with a full system of moving flats 150, with three inverter-stripper pairs 152, being used both before and after the moving flats. Inverters 114 and strippers 116 are retained in respective mounting assemblies 157, 158. It is clearly possible to use more inverters and fewer moving flats, with many combinations being possible. Using inverters in this way would improve the flexibility of short-staple cards for handing a range of difficult fibres such as microfibres, bleached cotton, or wool for use on the short-staple system. The inverters 114 may be used either with or without trays or ducts 155 to collect trash. If trash collection is not required, the inverters can be stacked much closer together, increasing the numbers that can be installed.

Figure 9:
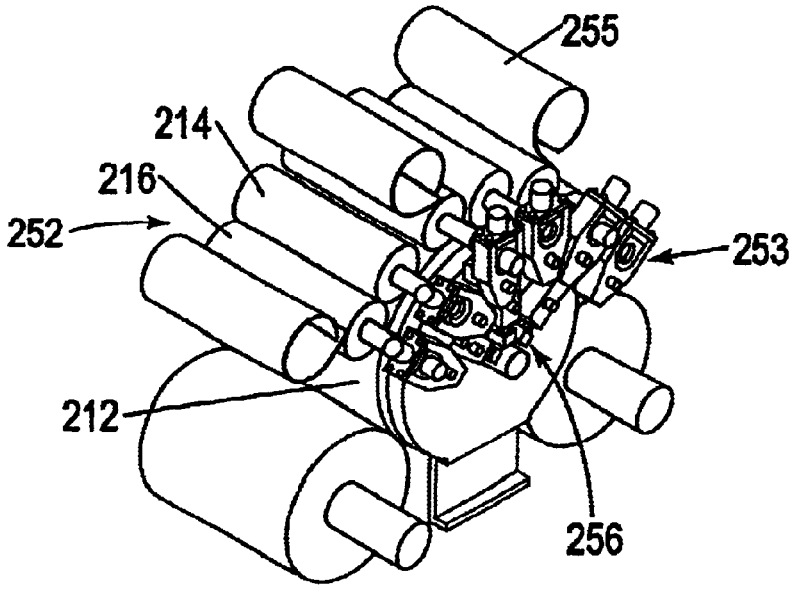
FIGS. 9 and 10 are respectively an isometric and side elevational view showing application of the inverters to the lickerin feed of a short-staple card, in a case where the overall length of the lickerin section is unaffected by the addition of the inverters.
Figure 10:
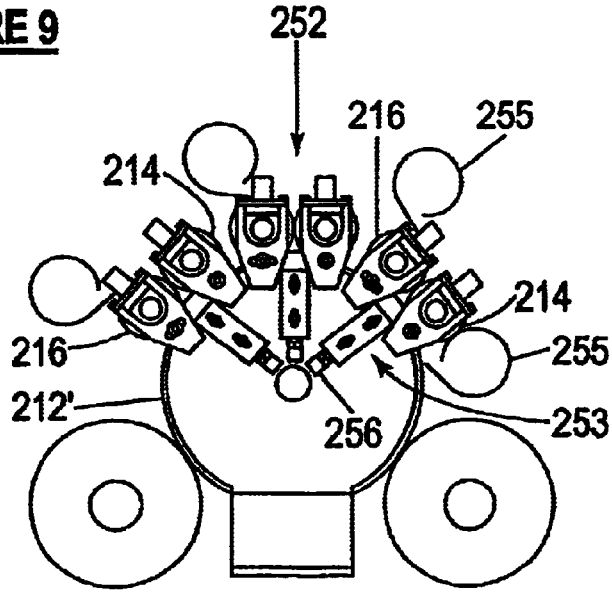

Some short-staple cards employ a more elaborate three lickerin system, an example of which is shown in schematically in FIG. 5. It is possible to apply inverters 214 to this lickerin, as shown in FIGS. 9 and 10, in order to provide greater opening of the fibre and removal of trash. FIGS. 9 and 10 show three inverter pairs 252 fitted onto a larger diameter middle roller 212 together with four ducts 255 for removing trash if required. Two additional ducts can be placed adjacent to the cylinder and just after the first two inverters 214 for even more cleaning. The diameter of the middle roller 212 has been set so that the overall length of the lickerin section remains unchanged, but clearly there are many other options employing rollers of various diameters that allow different combinations of inverters 214 and cleaning ducts 255.

Figure 12:
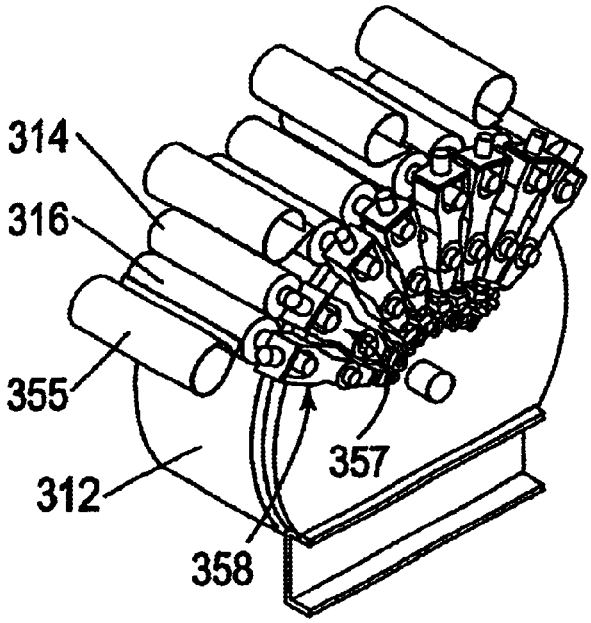
FIGS. 12 and 13 are views similar to FIGS. 9 and 10, for the case when the length of the lickerin is allowed to increase.
Figure 13:
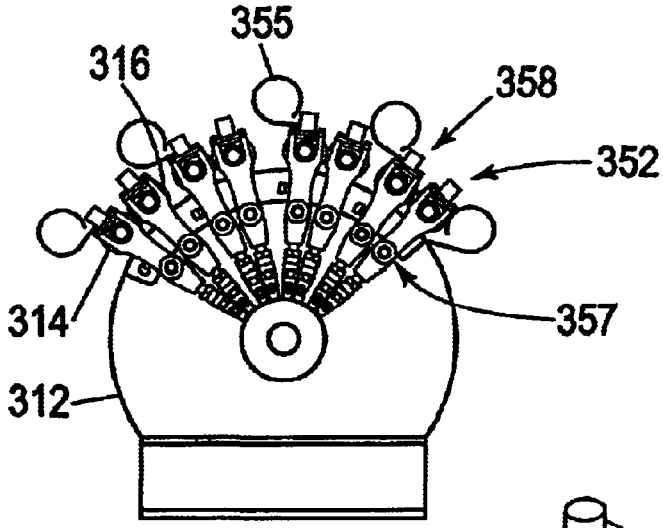

By broadening the design criteria to allow changes in the total length of the lickerin section, it is possible to increase the diameter of the middle roller and so provide more space to fit inverter-stripper pairs for even more opening. FIGS. 12 and 13 show one such arrangement where the diameter of middle roller 312 has been increased so that four inverter-strippers 352 can be fitted.

Figure 11:
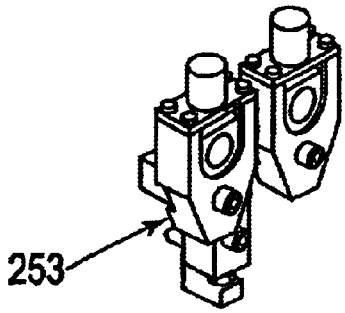
FIG. 11 shows a dual mounting bracket accommodating a stripper and an inverter, for use in the embodiment of FIGS. 9 and 10;.
Figure 14:
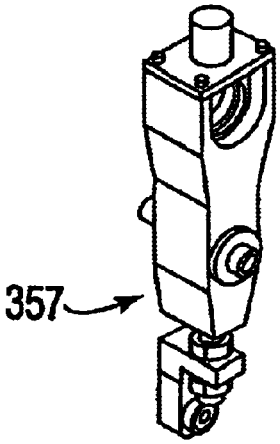
FIGS. 14 and 15 respectively show separate mounting brackets for the inverters and strippers, suitable for the embodiment of FIGS. 12 and 13.

When inverters are fitted to smaller diameter rollers, it is necessary to mount the inverters 214 and strippers 216 as a pair 252 on a single mounting 253 (FIG. 11), as shown in FIG. 10. If larger diameter rollers are used, it is possible to mount each roller 314, 316 of the pair separately in respective mounting assemblies 357, 358 (FIGS. 14, 15), as is shown in FIGS. 12 and 13, the advantage of which is that the settings of each roller can be adjusted independently. The details of the mounting arrangement for both methods are shown in FIGS. 11 and 14/15 respectively.

The design of the roller brackets has been modified in response to the smaller diameters of the inverter-stripper rollers and, in some cases, the smaller diameter of the cylinder. In the case when the rollers are mounted as a pair, FIGS. 9 to 11, the dual roller support 252 slides over a guide 256 that is bolted onto a side plate. An adjustable nut on a thread then enables the height of the pair to be finely adjusted providing practical control of the setting. Setting of the separation between the rollers is then provided by a slot in the holder for the stripper that allows fine adjustment of its position. Another feature of the holder is the use of a spring to hold the roller in position rather than rely on gravity, as with conventional designs. An advantage of using a spring is that all the holders are of the same shape, which contrasts with the normal situation where each holder has to be a different shape depending on its position around the cylinder. Another advantage is that the restoring force on the roller is always normal to the cylinder whereas with gravity this is only the case for the rollers at top-dead-centre of the card.

In the case of the supports for larger cylinders, and indeed the main cylinder, a preferred aspect of the design is the location of the pivot point at the lowest extremity of the support to reduce as much as possible the tendency for the setting to change with adjustment of the angular position of the roller.

Embodiment for Non-woven Carding

The close-packed format described for use in short-staple carding can also be used with benefit for non-woven carding, or even woollen carding, where the quality of the output sliver impacts directly on the final quality of the process. Inverters offer the possibility of using many more units than is currently possible with worker-strippers as well as the improved control of airflows.

Figure 16:
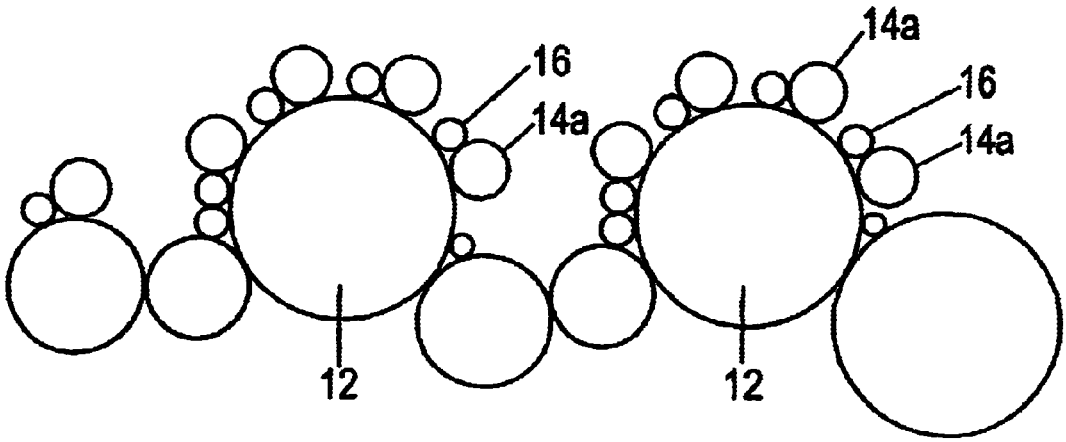
FIGS. 16 and 17 show an application of the invention to non-woven carding, the card being shown in its existing dimensions in FIG. 16 and in its modified form in FIG. 17.
Figure 17:
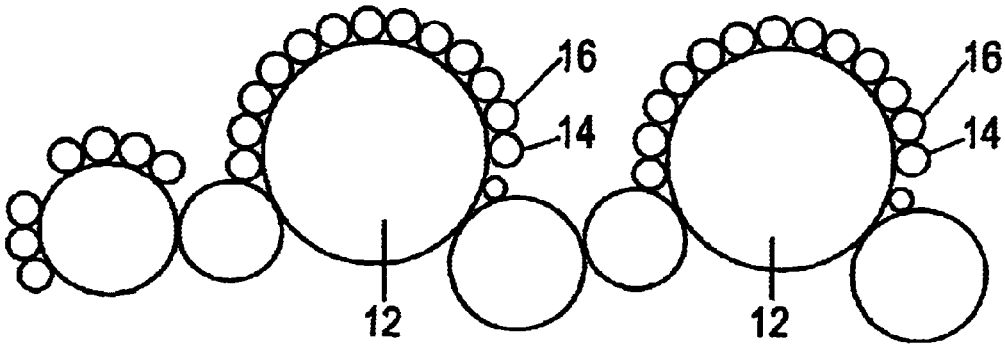

FIG. 16 illustrates a conventional non-woven card format. FIG. 17 shows the application of inverters in which the larger diameter workers 14*a* are replaced by inverters 14 that have the same diameter as the conventional strippers 16. A major benefit of the inverter-stripper format is that, as discussed, the subsequent stripper can be brought-in very close, enabling close packing of the units. Given the large diameters of the rollers, the controlling parameter for the position of the adjacent stripper in this case is to ensure some clearance between the pins of an inverter and the subsequent stripper at closest approach. The distance between the nips of the inverter and the adjacent stripper is 150 mm or more, much longer than required to avoid interference. The other benefit of the close-packed arrangement of inverter-stripper pairs is the improved control of airflows around the periphery of the cylinder 12, thereby reducing fibre loss and the generation of nep. This is particularly important with the very high cylinder speeds now in use, e.g., up to 2000 m/min on some machines.

The transfer of fibre from the inverter to the stripper is smoother than from a worker to a stripper, which reduces hooking of fibre and increases the alignment of fibres in the web. As a result, the webs produced by inverters tend to be more even than those produced by conventional workers.

Inverters could also be applied to woollen carding to increase the number of working points around the cylinders.

Embodiment for Worsted Carding

The output of a worsted card is a sliver that is typically subject to three stages of preparer gilling, combing, and two stages of finisher gilling to reach the final product (top). For this type of carding, the quality that is obtained from the number of workers normally used is sufficient given the extensive post-carding processing that is involved, i.e., in other words, there is less incentive to increase the number of working rollers. Although increasing the number of working rollers remains an option, the invention offers the alternative of significantly reducing current sizes while maintaining the existing number of opening rollers. The benefits would be in lower capital cost of the machine, because of shorter fabrication times, and greater flexibility in topmaking plants because of the reduced floor areas and ceiling heights required.

Figure 18:
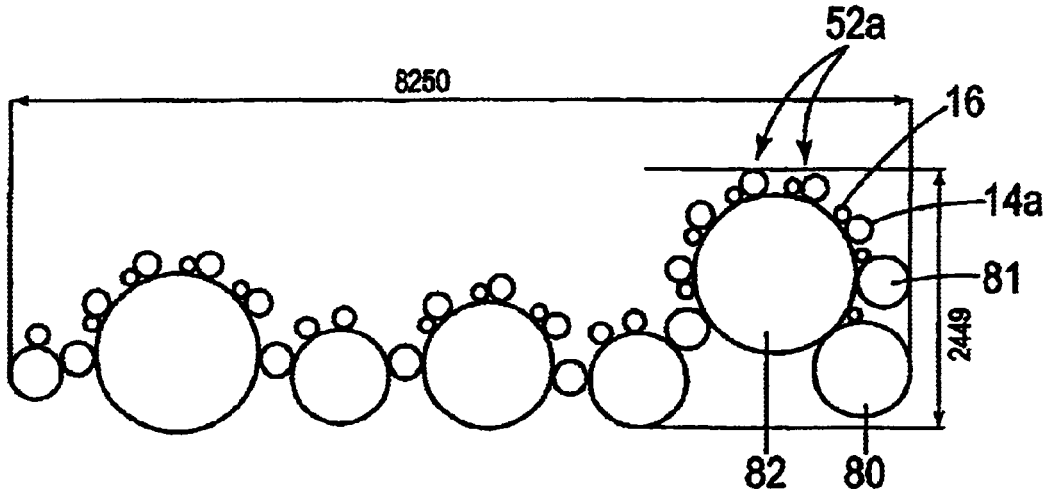
FIGS. 18 and 19 show schematically the reduction in the size of a modern worsted card that is possible with the use of inverters, the card being shown, on the same scale, in its existing dimensions in FIG. 18 and in its modified form in FIG. 19.
Figure 19:
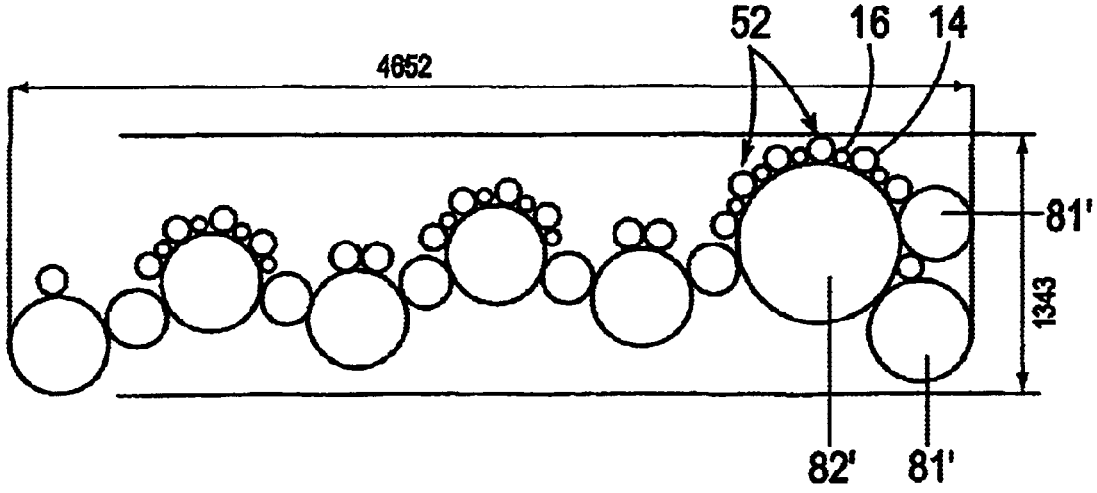

Accepting current practice that 5 worker/stripper pairs on the main cylinder (swift) is optimum for worsted carding, one possible scenario for using smaller inverter-stripper pairs is shown in FIGS. 18 and 19 for a 2500 mm wide machine. FIG. 18 is the layout of an existing high speed carding machine, the CA7 manufactured by Thibeau, and FIG. 19 depicts, on the same scale as that of FIG. 18, a layout incorporating an embodiment of the present invention. This card employs a cylinder denoted as a "pre swift" between the morels.

Calculations suggest that for the swift of a current high-speed card with a swift diameter of 1500 mm, the maximum number of inverter-stripper pairs that could be fitted is 8, which compares with 5 at present.

The diagram of FIG. 19 indicates schematically the very significant reduction in card size that is possible from using smaller diameter inverters 14 in accordance with the previous description. The length of the conventional CA7 high speed card (FIG. 18) is estimated as being some 8250 mm and the height is ca 2450 mm, without any allowance in the length for a hopper or can change or in the height for opening the covers above the swift. Reducing the inverter 14 diameter to 85 mm and maintaining the stripper 16 at 150 mm, including wire clothing, reduces the length and height of the card to about 4650 mm and 1340 mm respectively (FIG. 19).

More specifically, the actual space required for 5 inverter/stripper pairs 52 (FIG. 19) reduces from about 2800 mm for conventional worker-stripper pairs 52*a* (FIG. 18) to only 1600 mm for 120 mm diameter inverters. On the CA7, the diameters of the doffers 80, 81 are about 900 mm and 550 mm, which means that the total circumference of swift 82 that must be provided is about 4100 mm. The estimated total circumference is about 4700 mm. For inverters, by comparison, the total circumference required is estimated to be about 2400 mm, which means that the diameter could be reduced to about 800 mm, provided the diameter of the upper doffer 81' could be reduced to about 300 mm.

Instead of using inverters to reduce the size of the machine, it is within the scope of the invention to add additional rollers to increase the degree of opening. There is also the possibility of fitting stationary flats to the card to increase the working of the fibre if desired. In these cases, the swift diameter would remain about the same size and the potential reductions would be smaller, but the opening capacity would be significant increased.

As for the application of inverters to cotton carding discussed above, another opportunity is to fit trays around the swift to collect vegetable matter that is liberated by the strippers and the action of the teeth of the swift on the beard of fibre held by the inverter. Suction slots could also be used and will be essential to collect material from the upward sloping side of the cylinder.

What is claimed is:

1. A textile machine segment including a first or main roller adapted to support and convey a traveling fibre web, associated second and third rollers having respective nips, with each other and with the first roller as the three rollers rotate, and drive means for rotating the rollers, being arranged to rotate the second roller in a rotational direction that is the same as that of the first roller and opposite that of the third roller, wherein the second roller is downstream of the third roller and is cooperable with the first roller to open and detach a mat of fibre and convey the mat to the nip with the third roller, the mat of fibre being there transferred to the third roller and conveyed by the third roller to the nip with the main roller where it is transferred back to the first roller, and wherein the ratio of the diameter of said second and third rollers is less than 1.5.

2. A textile machine segment according to claim 1 wherein said rollers have a wire clothing about their cylindrical surfaces, which clothing includes a multiplicity of projecting pins or teeth all inclined in the direction of rotation.

3. A textile machine segment according to claim 2 wherein in the region of transfer of fibres from said second roller to the third roller, said pins or teeth of the respective rollers are inclined in the same direction.

4. A textile machine segment according to claim 3 wherein said third roller is of a diameter in the range 100 to 200 mm.

5. A textile machine segment according to claim 2 wherein the speed of said second roller is low compared with the speed of said first roller.

6. A textile machine segment according to claim 5 wherein the speed of the third roller is greater than the speed of the second roller, but lower then the speed of the first roller.

7. A textile machine segment according to claim 1 wherein the ratio of the diameters of said second and third rollers is substantially 1.0 or less.

8. A textile machine segment according to claim 1 wherein said second roller is of a diameter in the range 50 to 150 mm.

9. A textile machine segment according to claim 8 wherein said second rollers is of a diameter in the range 75 to 100 mm.

10. A textile machine segment according to claim 1 wherein said third roller is of a diameter in the range 100 to 200 mm.

11. A textile machine segment according to claim 10 wherein said third roller is of a diameter in the range 110 to 150 mm.

12. A textile machine according to claim 1, adapted for treating a wool fibre web, wherein the arc separation about the first roller between the nip of the third roller of a pair of said second and third rollers and the second roller of the next pair is no greater than 150 mm.

13. A textile machine segment according to claim 1, further including tray and/or duct means to collect waste and/or contaminant material separated from said web during said operation of said rollers.

14. A textile machine segment according to claim 1, in a textile carding machine.

15. A textile machine segment according to claim 1 wherein the speed of said second roller is low compared with the speed of said first roller.

16. A textile machine segment according to claim 15 wherein the speed of the third roller is greater than the speed of said second roller, but lower then the speed of the first roller.

17. A method of treating a travelling fibre web, including supporting and conveying the web on a rotating first roller, and operating respective pairs of second and third rollers cooperable with each other and at respective nips with the first roller whereby to open the web and detach a mat of fibre at the nip between the first and second rollers, to convey the mat to the third roller, and to return the mat to the first roller at the nip between the first and third rollers, wherein said operation of the respective pairs of second and third rollers is effected by rotating the second roller in a rotational direction that is the same as that of the first roller and opposite that of the third roller, and wherein the second roller is downstream of the third roller and the ratio of the diameters of the second and third rollers is less than 1.5.

* * * * *